US005927173A

United States Patent [19]

Lyons et al.

[11] Patent Number: 5,927,173

[45] Date of Patent: Jul. 27, 1999

[54] DISPENSER APPARATUS FOR FLEXIBLE DUCT CONNECTOR

[76] Inventors: John Lyons, 60 Green La., Levittown, N.Y. 11756; Allan A. Angerer, 2402 Eighth St., East Meadow, N.Y. 11554

[21] Appl. No.: 08/870,377

[22] Filed: Jun. 6, 1997

[51] Int. Cl.[6] ..... B26D 7/00

[52] U.S. Cl. ..... 83/650; 83/436.3; 83/607; 83/649; 83/650; 225/34; 225/36; 225/46

[58] Field of Search ..... 83/436.3, 436.5, 83/560, 607, 649, 650; 225/34, 36, 46

[56] References Cited

U.S. PATENT DOCUMENTS

| | | | |
|---|---|---|---|
| 3,156,391 | 11/1964 | Wicksall . | |
| 3,524,373 | 8/1968 | Helmus, Jr. | 83/522 |
| 4,419,820 | 12/1983 | Stumpf | 30/124 |
| 5,299,479 | 5/1994 | Wallmann et al. | 83/18 |
| 5,308,012 | 5/1994 | Fuller | 242/86.5 R |
| 5,316,232 | 5/1994 | Lambert, Jr. | 242/86.5 |
| 5,417,796 | 5/1995 | Lovelace et al. | 156/554 |

*Primary Examiner*—Peter Vo
*Assistant Examiner*—Kevin G. Vereene
*Attorney, Agent, or Firm*—Mark Basseches; Paul J. Sutton; Thelen Reid & Priest LLP

[57] ABSTRACT

A dispenser apparatus for holding, dispensing, and severing lengths of flexible duct connector material from side-by-side coils thereof includes a guide station and a cut-off station shiftable laterally of the apparatus and into alignment with a selected one of the coils. The coils are supported on an anti-friction cradle which includes anti-friction rollers extending laterally of the device, the ends of the rollers being supported on chains hung in catenary fashion. Since the rollers are capable of moving toward and away from each other, they are free to define a cradle which conforms to the periphery of the specific coil which is being fed to assure that the connector material may be withdrawn for processing with the lowest possible force.

2 Claims, 5 Drawing Sheets

DISPENSER APPARATUS FOR FLEXIBLE DUCT CONNECTOR

BACKGROUND AND FIELD OF THE INVENTION

The present invention relates to a dispensing apparatus particularly adapted for dispensing flexible duct connector from coils thereof and severing selected lengths from the coils. More particularly, the invention is directed to a dispenser device particularly adapted to store two or more coils of flexible duct connector material and to enable lengths of a selected one of said coils to be withdrawn from the stored position and severed.

It is conventional practice in the air conduits of air conditioning and heating systems to interpose between lengths of metal conduit, sections of flexible connector material. Representative patents showing the structure of the flexible connector material are: U.S. Pat. Nos. 3,197,850; 3,197,860; 3,214,807; 4,820,569; and 4,861,631, all assigned to the assignee of the instant application.

Flexible duct connector material comprises a pair of spaced parallel elongate metal bands, the opposed marginal edges of the bands being spanned by a flexible fabric material such as canvas, synthetic fabrics, or the like. In use, a length of flexible connector material is bent to assume the configuration of the opposed spaced air conduits. The respective metallic strips of the bent connector are affixed to the opposed conduits such that the flexible connector provides a continuation between the conduits. Importantly, vibrations in one of the conduits, such as the plenum of a furnace, are not transferred to the other of the conduits by virtue of the vibration absorbing fabric of the flexible connector material.

In order to accommodate the various duct configurations and uses, flexible connector material is supplied in a variety of sizes and types. For example, where the flexible duct is to be used in installations carrying air at high temperatures, an appropriate heat resistant fabric must be used. Similarly, the joining of small sized ducts dictates the use of lighter gauge metals in the flexible connector and vise versa. It will accordingly be appreciated that fabricators of duct systems must maintain a supply of a variety of types of flexible duct connector material.

The typical mode of packaging flexible connector material is in extended coils of one hundred feet or more. The coils may weigh upward of 80 pounds, and due to the stiffness of the material, is handled only with difficulty. More specifically, the conventional manner of dispensing flexible duct connector material is to pass the lead end of the connector coil through an aperture or open end of the box in which the coil is shipped. The selected length is withdrawn, measured, and severed prior to bending to the duct configuration.

A problem uniquely encountered in respect of the heavy coils of flexible connector material is to provide a mechanism whereby the coil may be freely unreeled. It is important to note that the outer diameter of the coil constantly changes as lengths of flexible material are withdrawn. Accordingly, it would be desirable to provide an anti-friction feed device which automatically compensates for the constantly changing peripheral configuration of the coil.

SUMMARY OF THE INVENTION

The present invention has as its object the provision of a dispensing apparatus especially adapted for flexible duct connector material, which is capable of holding and feeding two or more rolls of connector material. The apparatus comprises a frame having a roll storage station for holding a plurality of coils in side-by-side relation, the station being adapted to support a selected one of the coils on an anti-friction apparatus to facilitate withdrawal of a length of material from the selected coil. The apparatus includes a guide mechanism movable laterally of the frame so as to enable its alignment with the selected one of the coils. The apparatus includes a cut-off station likewise laterally movable relative to the frame so as to enable its alignment with the guide station and the coil which is to be dispensed. The apparatus further includes lift means for holding non-selected coils clear of the anti-friction apparatus to thereby facilitate feed of the selected coil.

It is accordingly an object of the invention to provide an apparatus for storing two or more lengths of flexible connector material, enabling lengths of connector material to be unrolled from a selected coil thereof, and enabling the selected length to be severed from the coil. A still further object of the invention is the provision of a unique anti-friction support for the selected coil adapted to accommodate itself automatically in accordance with the configuration of the periphery of the coil to be dispensed.

DETAILED DESCRIPTION OF DRAWINGS

Figure 1:
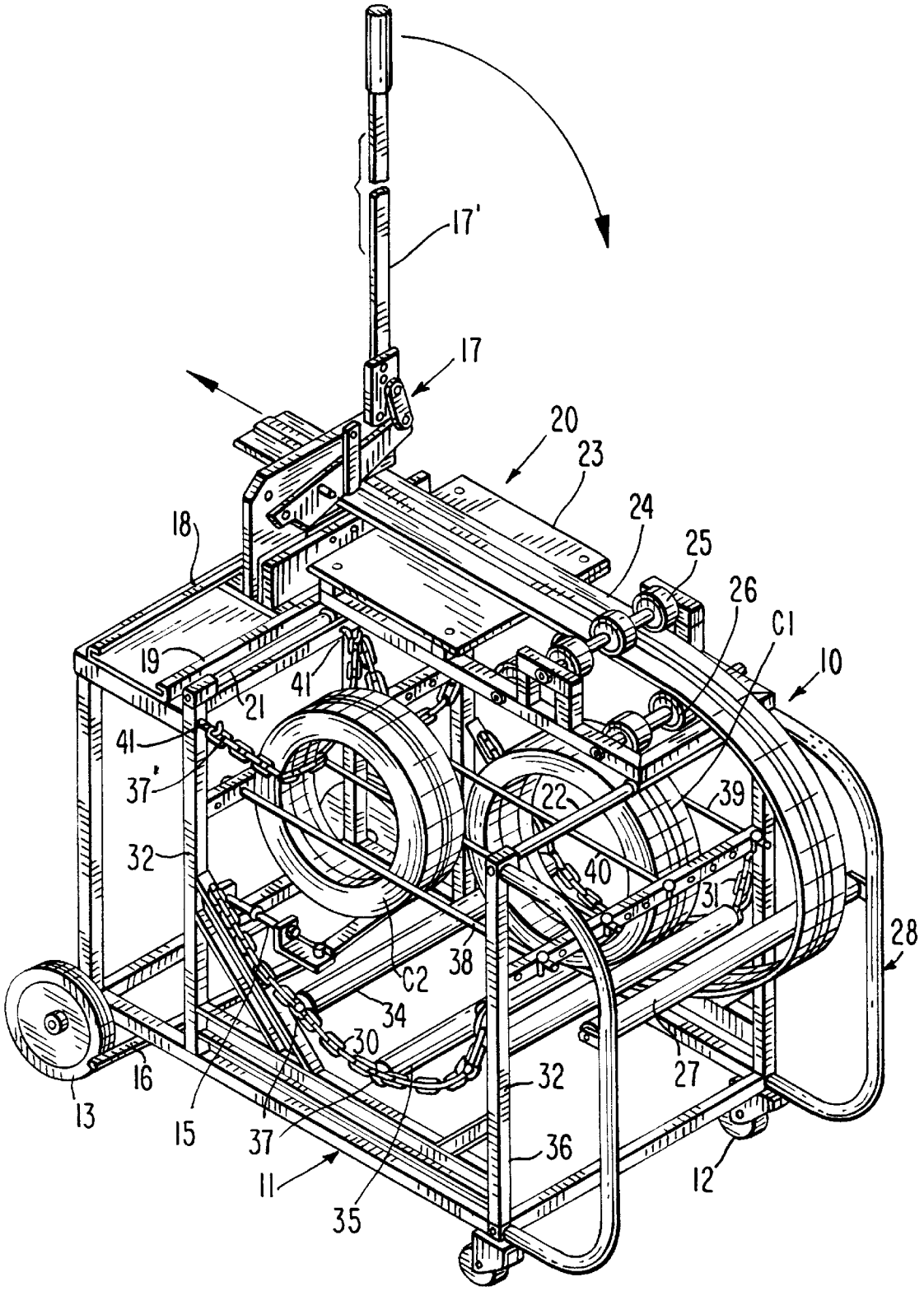
FIG. 1 is a perspective view of a dispenser apparatus in accordance with the invention.

Referring now to FIG. 1, there is shown in perspective a dispensing apparatus 10 in accordance with the invention. The apparatus includes a frame 11 which may be supported on wheels 12, 13 for portability. Optionally, a brake apparatus 15 may be provided for selectively shifting stop bars 16 into or out of engagement with wheels 13 for respectively locking the apparatus at a fixed location or enabling it to be moved to a desired location.

The device includes a cut-off mechanism 17 known per se mounted on laterally directed horizontal guides 18, 19, whereby the mechanism 17 may be shifted laterally to a selected position in alignment with flexible connector coils C1, C2, mounted on the dispenser in a manner more specifically set forth hereinafter. The apparatus includes a guide station 20 which is likewise laterally movably supported on guide rods 21 and 22. The guide station 20 includes a table 23 over which the connector material 24 may be drawn, after it is withdrawn from coil C1. More specifically, guide station includes upper and lower anti-friction rollers 25, 26 for guiding and constraining the material 24 as it emerges from the coil and passes about guide roller 27 at the rear end 28 of the dispenser apparatus.

Figures 2, 2A:
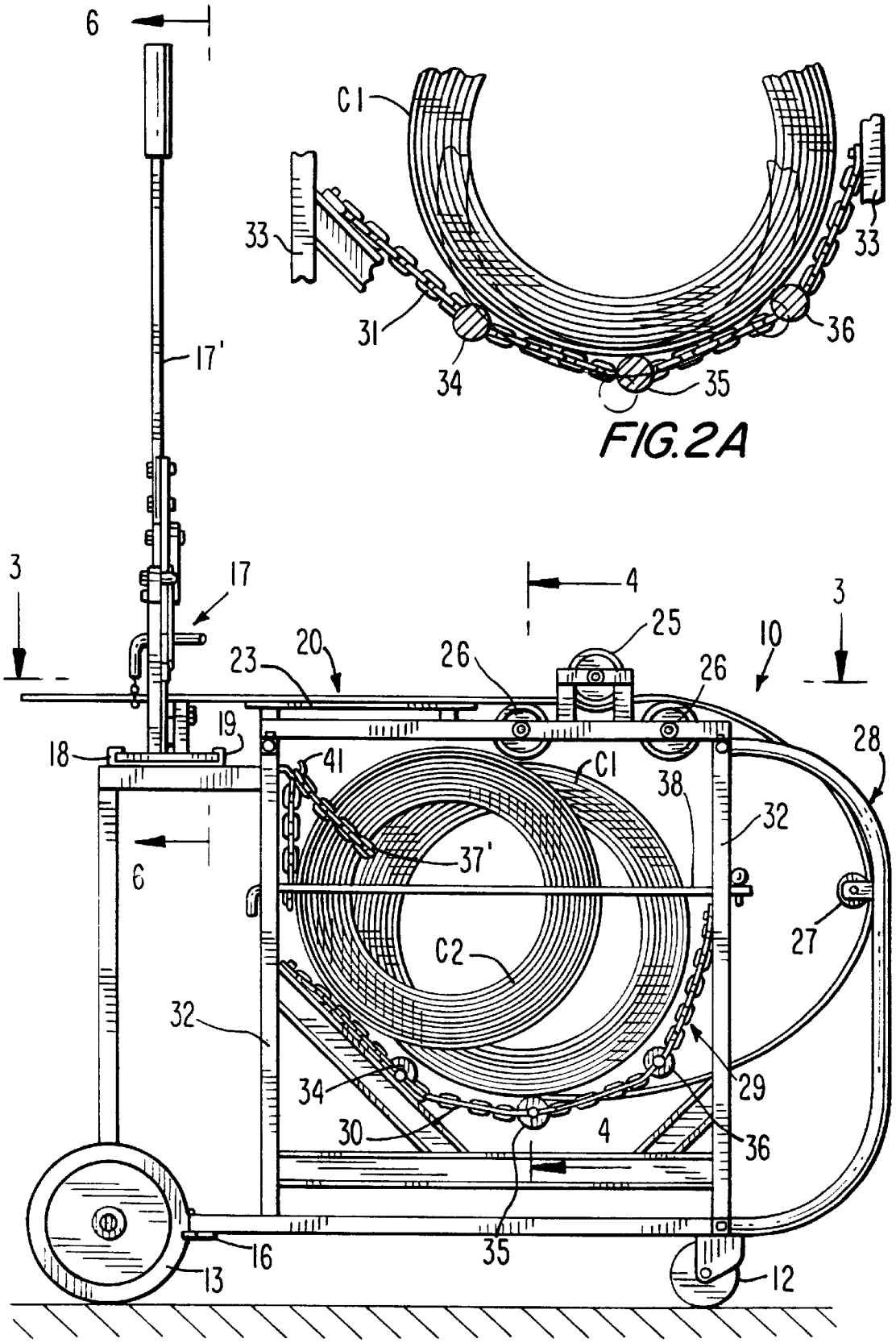
FIG. 2 is a magnified side elevational view of the apparatus.
FIG. 2*a* is a fragmentary side elevational view of the anti-friction coil support.
Figure 3:
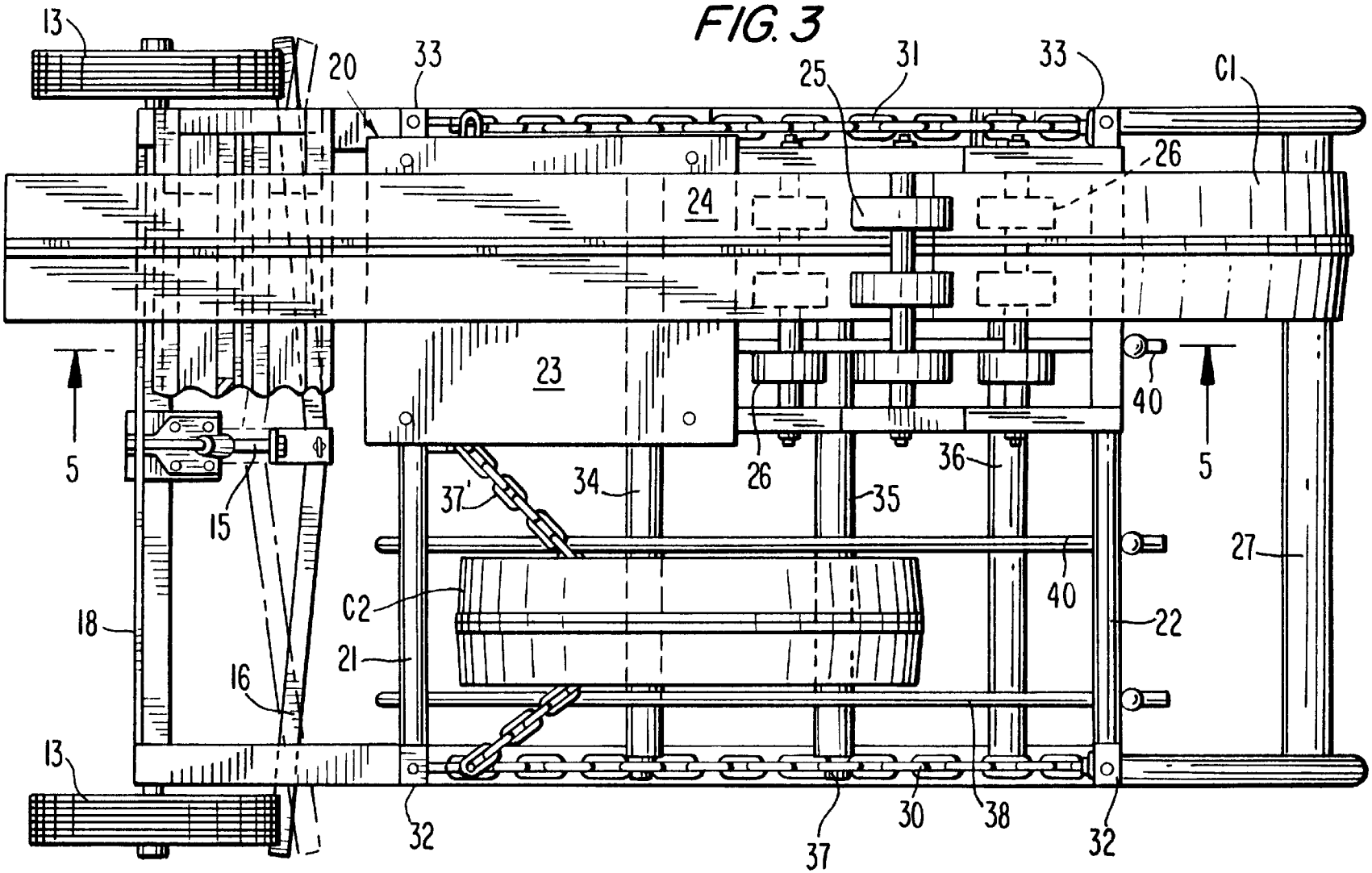
FIG. 3 is a plan view of the apparatus on a further enlarged scale.
Figure 4:
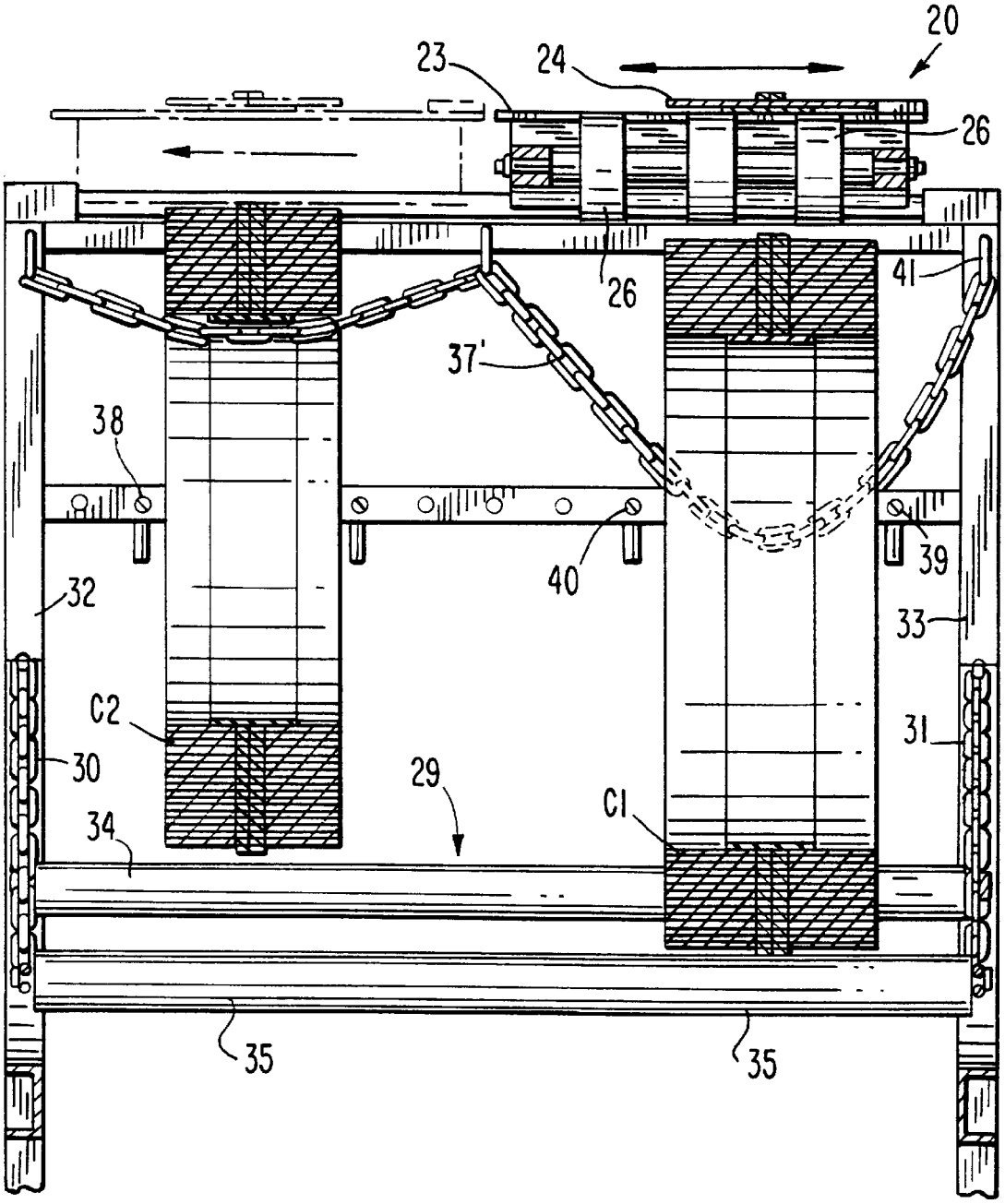
FIG. 4 is a further enlarged vertical section taken on the lines 4—4 of FIG. 2.
Figure 5:
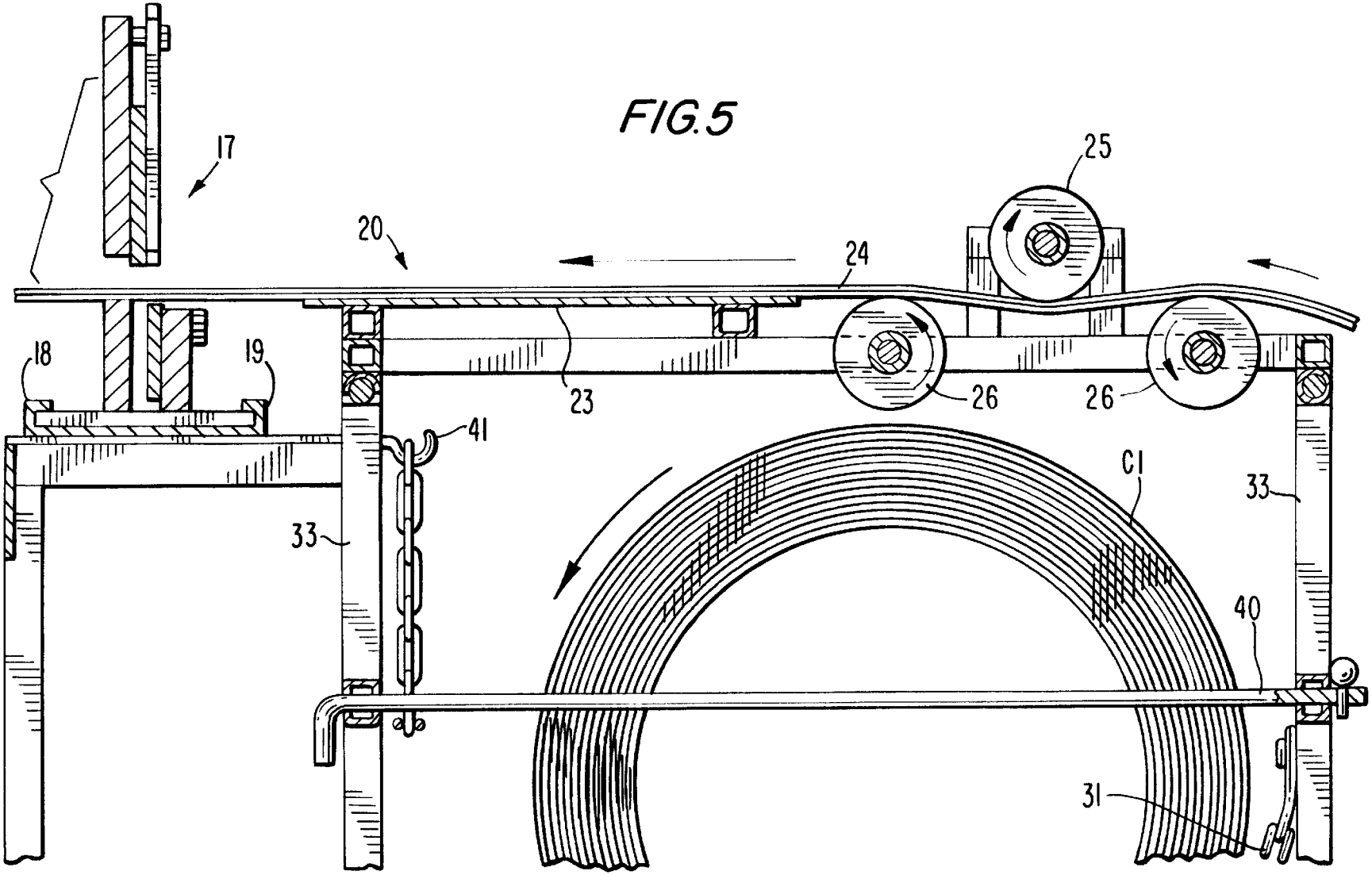
FIG. 5 is a fragmentary enlarged vertical section taken on the lines 5—5 of FIG. 3.

An important feature of the invention resides in the apparatus by which the coil (in this instance, C1) which is being fed, is supported in such manner that it can be readily unreeled at any of the various configurations which a coil will assume as it is being dispensed. More specifically, it will be readily recognized that the coils are of a first diameter prior to increments being dispensed, the outer diameter or periphery becoming progressively smaller as increments of the coils are extracted. Any drag or frictional resistance such as is experienced when lengths of coil are withdrawn while the coil is maintained in conventional cardboard containers, will greatly increase difficulty of unreeling material from the coil. It is the objective of the coil support apparatus 29, best depicted in FIGS. 2, 2*a* and 4, to hold the coil which is being dispensed in a manner which minimizes friction, at the same time being automatically continuously adapted to the varying peripheral size of the coil as it is being dispensed.

The apparatus 29 comprises a pair of laterally spaced-apart chains 30, 31 attached at their respective ends to vertical components 32, 33 of the frame, the chains 30, 31 hanging in a catenary fashion. The chains 30, 31 support spaced anti-friction rollers 34, 35, 36, forming a cradle spanning the chains and extending laterally of the device. The rollers include internal bearings (not shown) the inner component of the bearings being secured as at 37 to the chains.

Means are provided for assuring that only one coil is supported on the rollers 34, 35, 36 in this dispensing condition. As shown in FIG. 1, coil C1 is in the process of being dispensed and accordingly, lift means, in this instance, chain 37', passes through the center of coil C2 and is hooked to the frame whereby the coil is removed from rollers 34, 35, 36. It will be understood that as material is withdrawn from coil C1, the rollers 34, 35, 36 are driven by the periphery of coil C1 and thus would drive or rotate coil C2 if the latter were permitted to remain in contact with rollers 34, 35, 36.

It is important to note that since the rollers 34, 35, 36 are mounted on flexible chains 30, 31, the rollers will comply with the undersurface of coils of a variety of diameters. Specifically, a fresh, and hence, large, diameter coil will cause the rollers 34 and 36 to spread away from each other (see solid line position, FIG. 2*a*). As the material is fed and the diameter shrinks, the rollers will progressively move closer to automatically maintain minimum resistance of feed (dot and dash position of FIG. 2*a*). In either event, i.e., irrespective of the diameter of the coil, the weight of the coil will cause all of the rollers to engage the under periphery of the coil being fed due to the fact that the rollers are mounted on flexible chains.

While, for purposes of clarity, only two coils (C1 and C2) have been illustrated, it is feasible for the apparatus to accommodate three or more coils of flexible connector material.

Coils are loaded into the apparatus by removing loading bars 38, 39, providing access to the interior of the device. One or more separator bars 40 are interposed between adjacent coils to prevent interference therebetween.

The operation of the device will be apparent from the preceding description. Two or more coils, i.e., C1, C2, are loaded onto the support rollers 34, 35, 36 by appropriate removal and reinstallation of the loading and separator bars 38, 39, 40. When it is desired to remove a length from one of the coils, i.e., in the illustrated embodiment C1, the remaining coil or coils C2 are lifted clear of the rollers 34, 35, 36 as by chain 37'passed through the center of the coil, the opposite end of the chain being linked to hook member 41. It will be readily recognized that alternate lift means may be provided. Guide station 20 and cut-off mechanism 17 are shifted laterally into alignment with coil C1. The free end of coil C1 is shifted outwardly over roller 27 and upwardly into the nip between rollers 25 and 26 of the guide mechanism. Since the coil C1 is supported totally on and/or between anti-friction rollers, the coil may be readily advanced over table 23 and into the jaws of the cut-off mechanism 17. The table 23 may include an index marking for facilitating the calculation of the length of material withdrawn from coil C1. When the appropriate length is determined, operator bar $\mathbf{17}^1$ of cut-off mechanism 17 is actuated to sever the desired length of material. The increment of the coil C1 remaining after severing may be retracted and returned to the coil.

As will be apparent from the preceding description, there is provided in accordance with the invention a convenient apparatus for storing, dispensing, and severing lengths of flexible connector material from two or more rolls. The device has the unique advantage of enabling selected lengths of material to be extracted from the cumbersome coil of connector material with a minimum of difficulty. As will be apparent to those skilled in the art and familiarized with the instant invention, numerous variations in details of construction may be made without departing from the spirit of the invention. Accordingly, the invention is to be broadly construed within the scope of the appended claims.

We claim:

1. In a dispenser apparatus for storing and severing lengths from a selected one of two or more cylindrical coils of a flexible connector material disposed in side-by-side relation, each of said coils having a central axis and a lower periphery, said apparatus including a frame and a cut-off station on said frame, anti-friction support means adapted to support and conform to the configuration of said lower periphery of said selected one of said coils, comprising a spaced parallel pair of chain members having end portions secured to said frame, said members hanging in catenary configuration in planes perpendicular to said central axis of said selected one of said coils, a plurality of parallel anti-friction roller members extending between said chain members at spaced positions therealong, said roller members being shiftable toward and away from each other in accordance with the configuration of said chains, said rollers together supporting said lower periphery of said selected one of said coils, the spacing of said rollers varying progressively in accordance with the configuration of the coil supported on said rollers.

2. A dispenser apparatus in accordance with claim 1, wherein said cut-off station is shiftable in a direction parallel to said axes of said roller members.

* * * * *